United States Patent [19]

Ishikawa et al.

[11] Patent Number: 4,811,905

[45] Date of Patent: Mar. 14, 1989

[54] ELECTROMAGNETIC FUEL INJECTOR

[75] Inventors: Tooru Ishikawa, Katsuta; Tokuo Kosuge, Ibaraki, both of Japan

[73] Assignee: Hitachi, Ltd., Tokyo, Japan

[21] Appl. No.: 56,945

[22] Filed: Jun. 3, 1987

[30] Foreign Application Priority Data

Jun. 4, 1986 [JP] Japan ..... 61-127969

[51] Int. Cl.[4] ..... F02M 51/00

[52] U.S. Cl. ..... 239/585; 239/590.3; 239/DIG. 23

[58] Field of Search ..... 239/533.3–533.52, 239/585, 590, 590.3, DIG. 23

[56] References Cited

U.S. PATENT DOCUMENTS 4,116,389 9/1978 Furtah et al. ..... 239/585
4,385,339 5/1983 Takada ..... 361/154

FOREIGN PATENT DOCUMENTS 2942928 5/1981 Fed. Rep. of Germany ..... 239/585
3318480 5/1983 Fed. Rep. of Germany .
3244290 6/1983 Fed. Rep. of Germany ..... 239/585
3318486 2/1984 Fed. Rep. of Germany .
57-26262 2/1982 Japan ..... 239/585

*Primary Examiner*—Andres Kashnikow
*Assistant Examiner*—Kevin P. Weldon
*Attorney, Agent, or Firm*—Antonelli, Terry & Wands

[57] ABSTRACT

An electromagnetic fuel injector for internal combustion engines has a core defining therein a central bore and a fuel adjuster disposed therein and having an upstream end spaced downstream from an inlet end of the core. The central bore includes an inlet portion extending between the inlet end of the core and the upstream end of the fuel adjuster and providing an inner peripheral surface operative to guide the fuel in a laminar flow toward and into the fuel adjuster for thereby minimizing the occurrence of pulsated fuel pressure variation and voids which took place heretofore to cause cavitation in the fuel passage in the injector, whereby the range of fuel injection control can be widened.

7 Claims, 4 Drawing Sheets

ELECTROMAGNETIC FUEL INJECTOR

BACKGROUND OF THE INVENTION

The present invention relates to an electromagnetic fuel injector for use with internal combustion engines and, more particularly, to an electromagnetic fuel injector of the type which has a fuel passage formed in a core of an electromagnetic actuator.

An electromagnetic fuel injector has been known in which fuel is introduced into a fuel adjuster in a core of the electromagnetic actuator through a central fuel passage bore which is formed in the core. This type of fuel injector is disclosed, for example, in Japanese Unexamined Patent Publication No. 55-107061.

This type of fuel injector generally has a drawback that a turbulent flow of fuel, which is attributable to the configuration of the fuel inlet portion of the fuel injector, causes voids (or bubbles) and pulsation in the fuel. Such voids and pulsation produce unfavorable effects on the fuel metering precision of the fuel injector particularly when the injector is operated in a low-pulse driving range. This in turn makes it difficult to widen the operable range of the fuel injector in the low-pulse driving range.

SUMMARY OF THE INVENTION

Accordingly, an object of the present invention is to provide an electromagnetic fuel injector in which the occurrence of voids and pulsation of the fuel pressure caused by turbulence is remarkably suppressed so as to widen the low-pulse driving range of the injector and improve the precision of control of the fuel injection rate of the fuel injector.

The electromagnetic fuel injector according to the present invention has a core defining therein a central bore and a fuel adjuster disposed in the central bore and has an upstream end spaced downstream from the inlet end of the central bore. The central bore includes a substantially frusto-conical inner peripheral surface portion disposed and extending between the inlet end of the central bore and the upstream end of the fuel adjuster and converging toward the fuel adjuster.

The frusto-conical inner peripheral surface portion of the central bore is operative to minimize the occurrence of the turbulence of the fuel and thus the cavitation due to the turbulence thereby to decrease the pulsation of the fuel pressure in the injector whereby the precision of the amounts of fuel injected in the low-pulse driving range of the injector is improved with a resultant increase in the width of the operable range of the injector.

DESCRIPTION OF THE PREFERRED EMBODIMENTS

Figure 1:
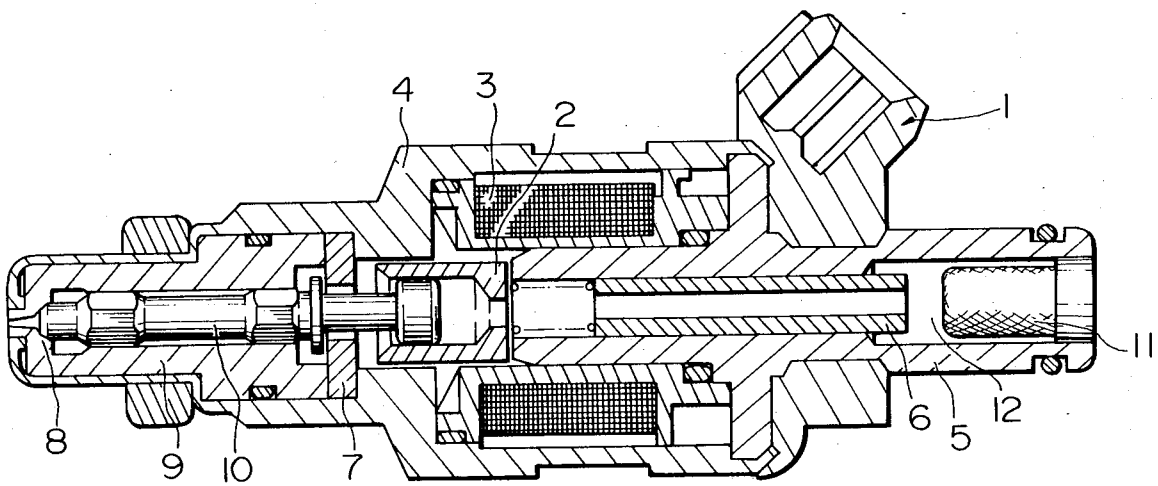
FIG. 1 PRIOR ART
FIG. 1 is a longitudinal sectional view of a conventional electromagnetic fuel injector.

A description will be made first as to the construction and operation of a typical conventional electromagnetic fuel injector. The fuel injector is generally denoted by a numeral 1 and has a seat portion 8 defining a fuel injection orifice which is adapted to be opened and closed so as to allow a pressurized fuel to be intermittently injected in response to an electric pulse signals applied to an electromagnetic coil 3. More specifically, when a pulse current is supplied to the electromagnetic coil 3, a magnetic path is formed to extend through a core 5, a yoke 4 and a plunger 2, so that the plunger 2 is driven to the right as viewed in FIG. 1 by an electromagnetic force. The plunger 2 is fixedly connected to a needle 10 which is slidably received in a nozzle 9. As the plunger 2 is moved to the right, the fuel injection orifice in the seat portion 8 is opened so as to allow the pressurized fuel to be injected. The fuel has been pressurized by a fuel pump, not shown, and regulated by a fuel pressure regulator, not shown. The fuel is then introduced into a fuel inlet portion 12 through a filter 11 placed in an outer end of the core 5. When the fuel injection orifice in the seat portion 8 is opened, the fuel is allowed to flow through a fuel adjuster 6 and then along both the inner and outer surfaces of the plunger 2. The fuel then flows through an annular gap between the needle 10 and the nozzle 9 and is injected through the injection orifice into an intake pipe of an engine which is not shown.

Figure 2:
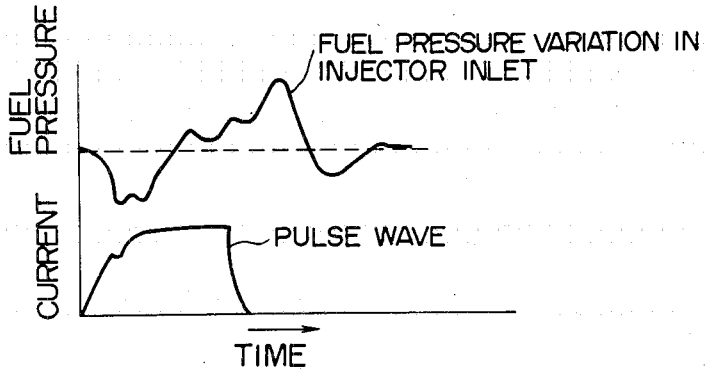
FIG. 2 PRIOR ART
FIG. 2 is a graph showing the result of measurement of fuel pressure and driving current in the electromagnetic fuel injector shown in FIG. 1.
Figure 3:
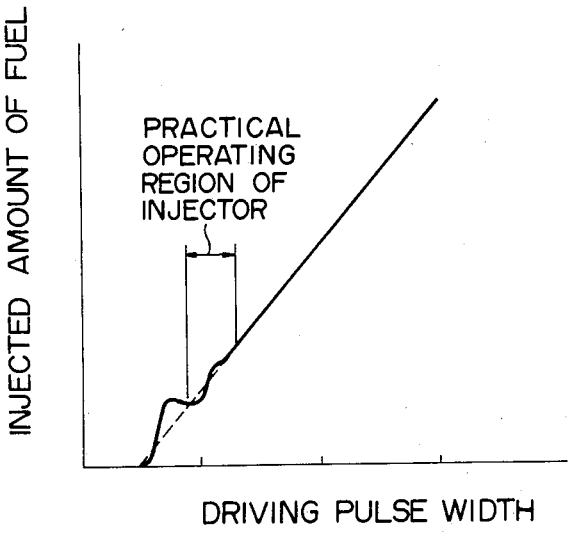
FIG. 3 is a graph showing the result of measurement of fuel injection rate characteristics of the electromagnetic fuel injector shown in FIG. 1.

FIG. 2 shows the result of measurement of fuel pressure in the fuel inlet portion 12 of the fuel injector 1, while FIG. 3 shows the fuel injection characteristic of the fuel injector. As will be seen from FIG. 2, the fuel pressure in the fuel inlet portion 12 is varied in a pulsating manner when driving electric current is supplied to the electromagnetic coil 3 of the fuel injector. From FIG. 3, it will be understood that the influence of pulsation of the fuel pressure becomes serious as the width of the driving pulse becomes smaller and the fluctuation of the injected amounts of fuel in the practical operating region of the fuel injector is large.

Figure 4:
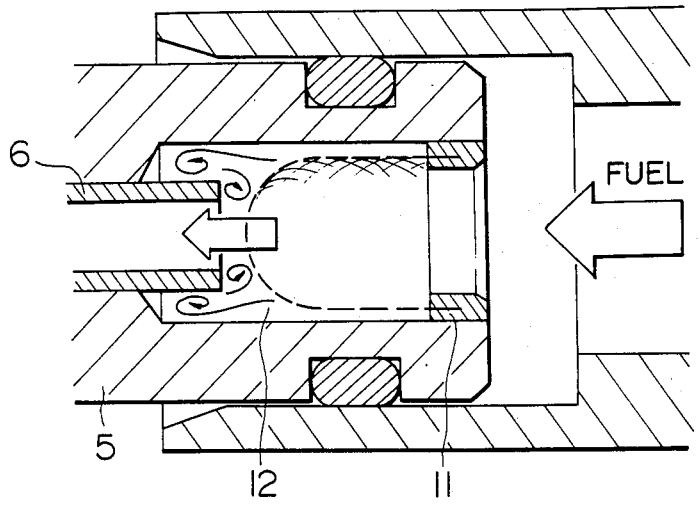
FIG. 4 PRIOR ART
FIG. 4 is a enlarged fragmentary sectional view of the electromagnetic fuel injector shown in FIG. 1, illustrating the turbulence of fuel in the fuel injector.

One of the causes of the pulsation of the fuel pressure in the fuel inlet portion is a turburence of flow of fuel which is generated, as shown in FIG. 4, by complicated configuration of the fuel passage in the fuel inlet portion which is defined by the core 5, the fuel adjuster 6 and the filter 11. The turburent flow of the fuel causes the pulsation of the fuel pressure and causes voids to be formed in the fuel, resulting in the occurrence of cavitation.

Figure 5:
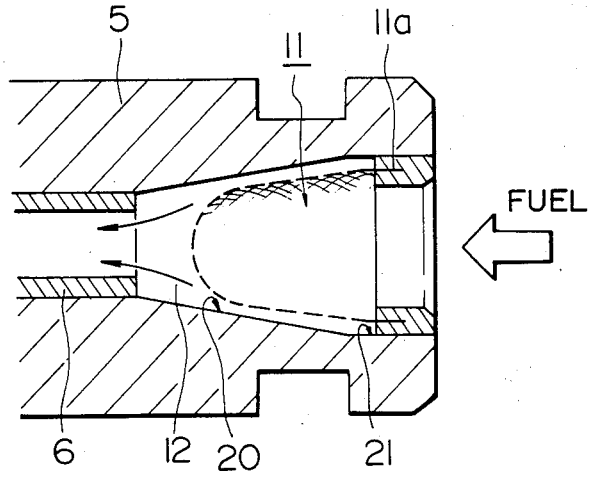
FIG. 5 is an enlarged fragmentary sectional view of an embodiment of the electromagnetic fuel injector of the present invention.
Figure 6:
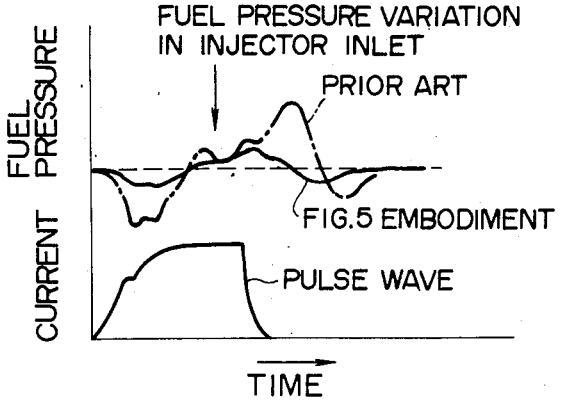
FIG. 6 graphically shows the result of measurement of the fuel pressure in the fuel injector in accordance with the present invention.

FIG. 5 shows an embodiment of the electromagnetic fuel injector of the present invention. In this embodiment, in order to minimize the turburence and thus the cavitation in the fuel inlet portion 12 so as to enable the fuel to be smoothly introduced into the fuel adjuster 6, the inner peripheral surface of the core 5 defining the fuel passage is tapered and the fuel adjuster 6 is disposed downstream of the tapered inner peripheral surface of the core 5. FIG. 6 shows the result of measurement of the pressure variation in the fuel inlet portion 12 of the fuel injector shown in FIG. 5 as well as the result of measurement of the pressure variation in a conventional fuel injector. It will be seen that the fuel pressure variation in the fuel injector of the present invention is as small as about ⅓ of that observed in the conventional fuel injector. It will be understood that the present invention enables the electromagnetic fuel injector to be operable in a wider range in the low-pulse driving region, as well as remarkably suppresses the formation of voids.

Figure 7:
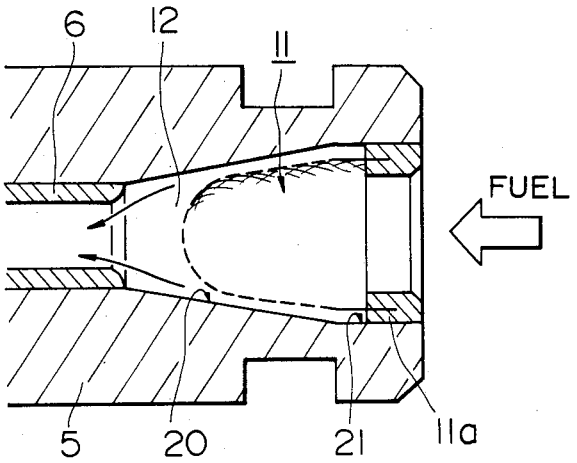
FIG. 7 is similar to FIG. 5 but illustrates another embodiment of the invention.

FIG. 7 shows another embodiment of the electromagnetic fuel injector in accordance with the present invention. In this embodiment, the outer end surface of the fuel adjuster 6 adjacent to the fuel inlet portion 12 is smoothly curved with a radius of curvature of 1 to 1.5 mm which affects the flow of the fuel impinging upon this end surface of the fuel adjuster 6. In consequence, a smooth flow of fuel is attained so as to further reduce the pulsation in the fuel pressure and formation of voids.

The fuel inlet portion 12 of each embodiment of the electromagnetic fuel injector will be described in more detail. The inner peripheral surface of the fuel inlet end portion 12 of the core 5 includes a cylindrical upstream end portion 21 into which a support ring 11*a* for the filter 11 is press-fitted. The tapered inner peripheral surface of the core 5 starts from the downstream end of this cylindrical portion 21 so as to define a fuel passage having a frusto-conical wall surface 20. The adjuster 6 extends axially inwardly from the downstream end of the frusto-conical surface 20 of the fuel passage. The wall thickness of the adjuster 6 is substantially the same as the wall thickness of the support ring 11*a* for the filter 11.

The ratio between the inside diameter of the fuel adjuster 6 and the inside diameter of the support ring 11*a* is 1:2 and the distance between the fuel adjuster 6 and the support ring 11*a* is about 4 times as large as the inside diameter of the adjuster 6.

The frusto-conical wall surface 20 of the core 5 is substantially similar to an imaginary frustoconical plane which is generated by the revolution of a line which interconnects the inner peripheral edge of the upstream end of the fuel adjuster 6 and the inner peripheral edge of the downstream end of the support ring 11*a*.

The filter 11 has a frusto-conical portion having a frustoconical outer peripheral surface which is positioned between and extends along the frusto-conical wall surface 20 and the above-mentioned imaginary frustoconical plane, and a downstream end portion which has an arcuate form when viewed in section taken along the axis of the filter. The downstream end of the filter 11 is spaced from the inlet or upstream end of the fuel adjuster 6 by a distance substantially equal to the inside diameter of the fuel adjuster 6.

The frusto-conical wall surface 20 of the fuel passage formed in the core 5 and the frusto-conical filter 11 having an arcuate end portion provide an effect which allows the fuel to flow substantially in the form of laminar flow. In consequence, the fuel is smoothly introduced into the fuel passage in the adjuster 6.

It has been confirmed that the pressure variation or pulsation in the fuel passage in the fuel inlet portion 12 of the fuel injector is remarkably suppressed even when the fuel supply pressure is increased from 1 atm to 2155 atm, thus allowing the electromagnetic fuel injector to operate at a higher pressure.

As will be apparent from the foregoing description, the present invention eliminates the turbulence of fuel which inevitably occurred in the conventional electromagnetic fuel injectors and caused unfavorable effect on the precision of control of the injected amounts of fuel. Thus, the present invention enables electromagnetic fuel injector to be operable over a widened range and, particularly, in the low-pulse driving region.

What is claimed is:

1. An electromagnetic fuel injector including an electromagnetic coil, a core defining therein a central bore for passing fuel into the injector, a substantially tubular fuel adjuster disposed in said central bore and defining a fuel passage, said fuel adjuster having an upstream end spaced a distance downstream from an inlet end of said central bore, said central bore in said core having a substantially frusto-conical inner peripheral surface portion disposed between said inlet end of said central bore and said upstream end of said fuel adjuster and converging toward said fuel adjuster to cause a laminar flow of the fuel toward and into said fuel adjuster, a support ring fixed to an inlet end of said frusto-conical inner peripheral surface portion of said central bore, and a substantially frusto-conical filter supported by said support ring and having a frusto-conical outer peripheral surface disposed inwardly of and extending substantially along said frusto-conical inner peripheral surface portion, wherein said frusto-conical surface portion is substantially similar to an imaginary frusto-conical plane generated by revolution of a line which interconnects an inner peripheral edge of an upstream end of said fuel adjuster and an inner peripheral edge of a downstream end of said support ring;

said filter has a portion having a frusto-conical outer peripheral surface positioned between said frusto-conical peripheral surface portion of said core and said imaginary frusto-conical plane and being substantially similar thereto; and said filter has a downstream end portion having an arcuate form as viewed in an axial section and spaced from said upstream end of said fuel adjuster a distance substantially equal to an inside diameter of said fuel adjuster.

2. An electromagnetic fuel injector according to claim 1, wherein said upstream end of said fuel adjuster has an inner peripheral edge which is rounded, as viewed in an axial section, with a predetermined radius of curvature.

3. An electromagnetic fuel injector according to claim 1, wherein the ratio between the inside diameter of said fuel adjuster and the inside diameter of said support ring is 1:2.

4. An electromagnetic fuel injector according to claim 2, wherein the ratio between the inside diameter of said fuel adjuster and the inside diameter of said support ring is 1:2.

5. An electromagnetic fuel injector according to claim 1, wherein the distance between said upstream end of said fuel adjuster and the downstream end of said support ring is substantially four times the inside diameter of said fuel adjuster.

6. An electromagnetic fuel injector according to claim 2, wherein the distance between the upstream end of said fuel adjuster and the downstream end of said support ring is substantially four times the inside diameter of said fuel adjuster.

7. An electromagnetic fuel injector according to claim 3, wherein the distance between the upstream end of said fuel adjuster and the downstream end of said support ring is substantially four times the inside diameter of said fuel adjuster.

* * * * *